US006845979B2

(12) United States Patent
Chiari et al.

(10) Patent No.: US 6,845,979 B2
(45) Date of Patent: Jan. 25, 2005

(54) INDEPENDENT DEVICE FOR SYNCHRONIZATION OF SHEET OPERATIONS AND CONVEYANCING

(75) Inventors: Mauro Chiari, Denges (CH); Daniel Tapis, Aran (CH)

(73) Assignee: Bobst, S.A. (CH)

( * ) Notice: Subject to any disclaimer, the term of this patent is extended or adjusted under 35 U.S.C. 154(b) by 0 days.

(21) Appl. No.: 10/645,138

(22) Filed: Aug. 21, 2003

(65) Prior Publication Data

US 2004/0036209 A1 Feb. 26, 2004

Related U.S. Application Data

(62) Division of application No. 10/057,064, filed on Jan. 24, 2002, now Pat. No. 6,691,997.

(30) Foreign Application Priority Data

Feb. 1, 2001 (CH) ..... 0179/01

(51) Int. Cl.[7] ..... B65H 5/00
(52) U.S. Cl. ..... 271/264
(58) Field of Search ..... 271/264

(56) References Cited

U.S. PATENT DOCUMENTS

| | | | | |
|---|---|---|---|---|
| 3,184,229 A | | 5/1965 | Weber | 271/3 |
| 4,093,904 A | | 6/1978 | Burig et al. | 318/616 |
| 4,453,436 A | | 6/1984 | Tokuno | 83/76 |
| 5,348,285 A | | 9/1994 | Hüser | 271/183 |
| 6,345,171 B1 | * | 2/2002 | Suga | 399/396 |
| 6,370,354 B1 | * | 4/2002 | Chapman et al. | 399/394 |
| 6,499,397 B2 | * | 12/2002 | Stern | 101/248 |
| 6,691,997 B2 | * | 2/2004 | Chiari et al. | 271/3.04 |

FOREIGN PATENT DOCUMENTS

| | | | |
|---|---|---|---|
| CH | 219422 | 6/1942 | |
| CH | 411 555 | 11/1966 | |
| CH | 411555 | 11/1966 | 3/4 |
| JP | 07302103 | 11/1995 | |

* cited by examiner

*Primary Examiner*—Donald P. Walsh
*Assistant Examiner*—Kenneth W. Bower
(74) *Attorney, Agent, or Firm*—Ostrolenk, Faber, Gerb & Soffen, LLP

(57) ABSTRACT

An independent motor/reductor drives a conveyance device that feeds a converting press. The converting press includes a number of stations including a feeding station, a converting station, a waste stripping station and a delivery station. The conveyance device services the stations and includes two endless gripper bar chains to convey sheet material through the converting press. A transverse drive shaft drives the conveyance device under the control of the independent motor/reductor. The independent motor/reductor provides motion trajectories for the conveyance device that are independent of, but synchronized with, the serviced stations. The arrangement improves throughput, reduces machine wear and results in a simplified design.

6 Claims, 3 Drawing Sheets

INDEPENDENT DEVICE FOR SYNCHRONIZATION OF SHEET OPERATIONS AND CONVEYANCING

CROSS REFERENCE TO RELATED APPLICATION

This is a divisional of U.S. patent application Ser. No. 10/057,064, filed Jan. 24, 2002 now U.S. Pat. No. 6,691,997 in the name of Mauro Chiari and Daniel Tapis and entitled INDEPENDENT DEVICE FOR SYNCHRONIZATION OF SHEET OPERATIONS AND CONVEYANCING.

BACKGROUND OF THE INVENTION

The present invention relates to a device for sheet conveyance, into a converting press for paper or cardboard sheets comprising at least one feeding station, a converting station, a waste stripping station and a delivery station for converted sheets, said conveyance device including two endless gripper bar chains assembled for conveying the sheets from the feeding station to the delivery station, a transverse driving shaft equipped with driving wheels for the endless gripper bar chains and at least one device for sheet capture secured to the endless gripper bar chains.

The wording "transverse" here means a horizontal direction, perpendicular to the machine axis.

Concerning known converting presses, only one electric motor usually drives the whole machine. This motor directly actuates inertia flywheels, a clutch brake device being inserted between the flywheels and the other machine bodies. This system drives all elements functioning with synchronism, in particular the movable beam of the platen press, the waste stripping and blank delivering stations, as well as the chains bearing the gripper bars ensuring sheet capture and conveyance from one station to the next.

A sheet conveying and converting cycle includes a sheet stop phase during which a given sheet is conveyed to a converting operation, such as blanking or waste stripping, and at least one moving phase during which the sheet is conveyed from one station to the next. This moving phase necessarily includes an acceleration and a deceleration phase and, usually, between both, a phase during which the sheet moves at a constant speed.

Various embodiments carrying out this kind of cycle have been described, in which the wheels driving the chains are interdependent in rotation with a coupling unit. The coupling unit is alternately caught or released from a driving unit by axial displacement. Standby means release or immobilize the wheels driving the chains, although the driving unit is alternatively driven in one or another rotative direction.

Such mechanical devices were described for example with patents CH 219422 and CH 411555. For such devices, an oscillating toothed segment operates on the transverse driving shaft via a pinion. The toothed segment is actuated by a rod connected to an eccentric secured on the top of a shaft driven by the general machine driving device. A complete rotation of the machine driving device causes an entire back and forth run of the oscillating toothed segment.

This kind of mechanical drive deals with a single motion law, determined by the geometry of the parts. This kind of driving device is very suitable for low or average conveyor rates up to approximately 5,000–6,000 sheets/hour. Beyond these rates, accelerations and decelerations at the beginning and at the end of the motion phase become very strong. However, after the sheet blanking operation, the sheets are connected only by their nicks, which can break in the case of heavy acceleration, causing a machine jam.

Several mechanical devices have been proposed to overcome this defect. The patent CH 411555 suggests driving the toothed segment under the control of a double cam. One of the double cams sends a rocking motion to a lever which, by means of a connecting rod, drives the toothed segment. Another of the two lever elements cooperating with the two cams sends the back free motion to the toothed segment, and is elastically engaged against the cam. The cam system modifies the effect of the motion law by relieving the start-up forces. However, for a set of reference cams, the acceleration forces are relieved for a set range. If other ranges of operation concerning the motion are desired, the cams must be changed.

Another known device attempts to remove the time delay for the blanking operation. In one such device, the manufacturer provided two blanking station platens that travel together in linear motion with the blanked sheets. This solution removes the time delay involved in the blanking operation, while permitting modulation of the linear displacement motion of the endless gripper bar chains.

SUMMARY OF THE INVENTION

The aim of the present invention is to provide a device for sheet conveyance allowing high throughput rates while carrying out an optimal sheet conveying cycle without any overly strong accelerations that could potentially break the nicks between the sheets blanks. Another aim of the invention is to allow rate changes for the sheet conveying cycle, independently from the conveying cycle of the converting station. The rate modification of a sheet conveying cycle involves the conveyor acceleration and deceleration curves and the respective duration of a cycle phase according to the type of processing carried out. The rate of the sheet conveying cycle can be changed between different processing jobs without having to retool or change parts.

These aims are achieved by a sheet conveyance device according to the present invention. A sheet conveyance device far a converting press for paper or cardboard sheets is provided. The press comprises at least one feeding station, a converting station, a waste stripping station and a delivery station for converted sheets. The conveyance device includes two endless gripper bar chains arranged for conveying the sheets from the feeding station to the delivery station, a transverse driving shaft equipped with driving wheels for the endless gripper bar chains and at least one device for sheet capture secured to the endless gripper bar chains. The transverse driving shaft of the conveyance device is driven separately from the other press stations, by at least one independent motor. The independent motor can operate with driving cycles comprising at least one motion phase and one phase of deceleration and/or stops controlled by a control device. The duration of each independent motor driving cycle is equivalent to the duration of a converting cycle of said converting station.

The driving of the sheet conveyance device by a motor independent of the motor driving the other converting press stations was initially thought to be an inadequate model, because of the problem of proper synchronization between the sequential sheets and the blanking platen operation of the downstream stations. The inventors noted to the contrary that an appropriate command, particularly an electronic command, can properly synchronize the conveyor with a platen cycle. The drive command is synthesized from a representative signal for the blanking station platen location and a representative signal for the gripper bar chains location. The appropriately synthesized drive command can control the independent motor driving the gripper bar chains to run with optimal synchronism related to the platen cycle. During a conveying cycle, a control device driving the independent motor by delivering a suitable electrical current is able to adapt to changing demands and forces with much more flexibility than a mechanical device. The control device can vary the characteristics of the acceleration phase, of the deceleration phase and of the braking phase of the conveying device with greater consistency, simplicity and ease than a mechanical device, as well. The conveying by means of the independent motor in particular, permits better adjustment of the relative duration of the moving and braking phases of the gripper bar chains with respect to the moving and braking phases of the diecutting platen. Such an arrangement can decrease the duration of the platen braking phase, which permits an increased machine production rate.

BRIEF DESCRIPTION OF THE DRAWINGS

Other characteristics and advantages will be apparent to one skilled in the art from the description of an embodiment of the invention, with reference to the drawings, in which.

DETAILED DESCRIPTION OF THE PREFERRED EMBODIMENTS

Figure 1B:
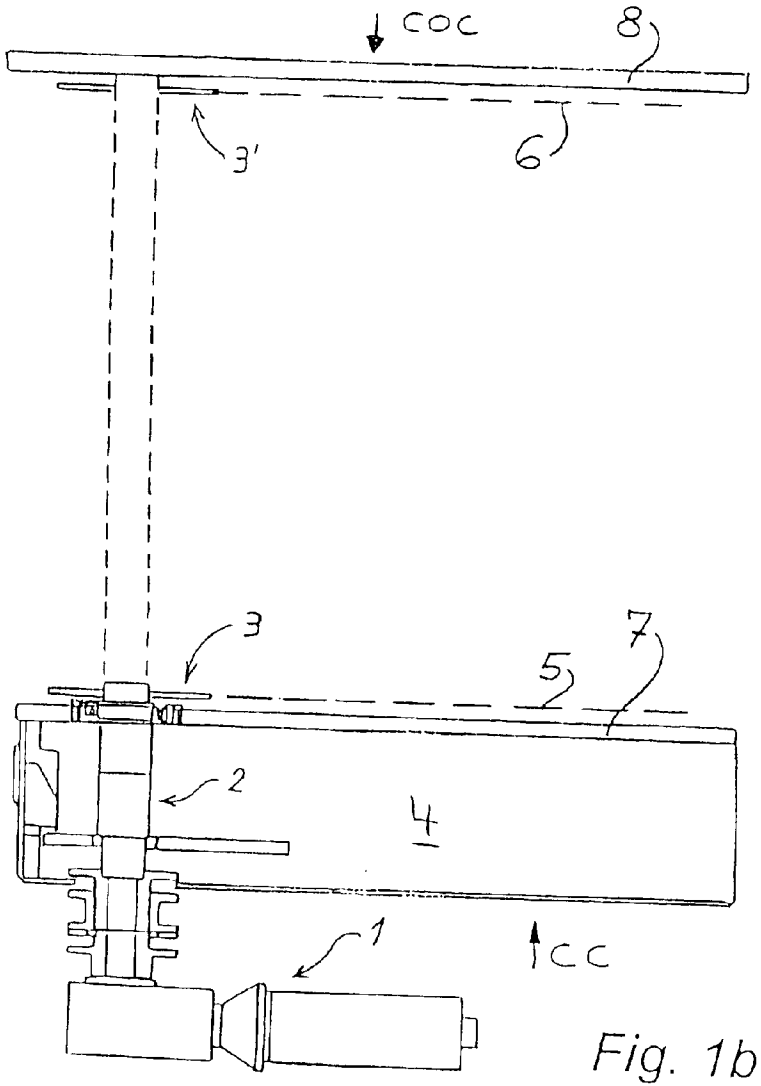
FIGS. 1*a* and 1*b* are a side view and a top view, respectively, of an arrangement of a driving motor for a conveyance device feeding a converting press.
Figure 1A:
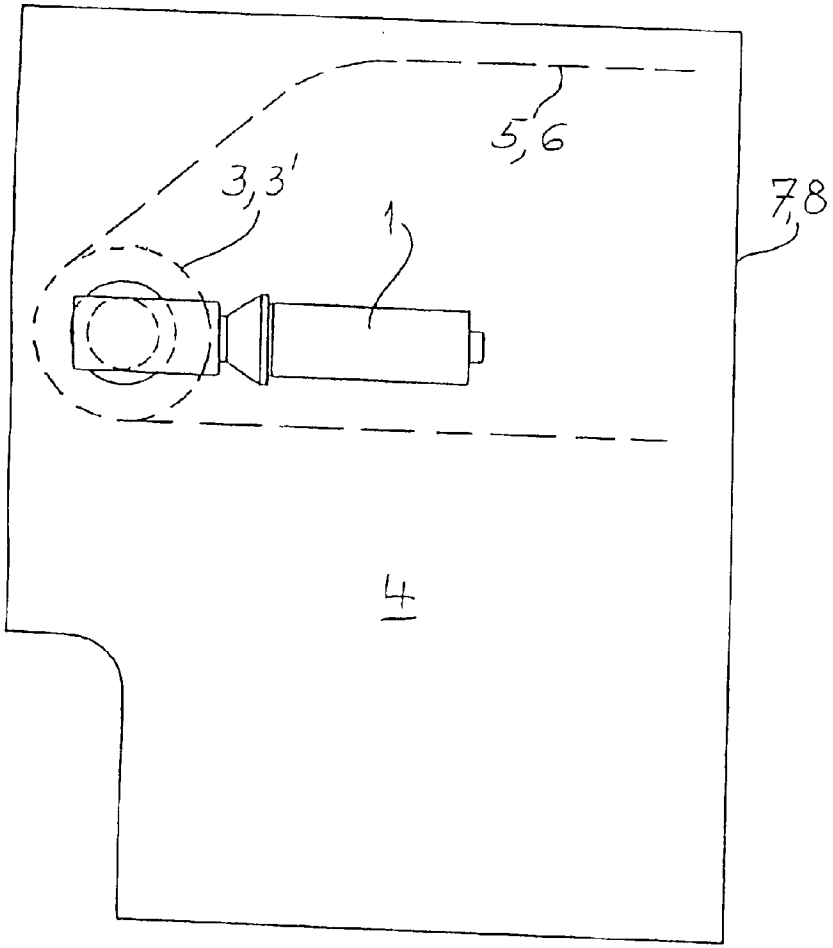

FIGS. 1*a* and 1*b* show an independent motor/reductor unit 1 directly assembled with an extension of a transverse driving shaft 2 which comprises driving wheels 3, 3' of endless gripper bar chains 5, 6 of a converting press. As noted in FIG. 1*a,* motor 1 is located at a unit 4, which is shown to illustrate a prior art converting press arrangement including a mechanism for driving the gripper bar chains 5, 6 and mechanical parts coupling the motor to the various actuated press stations. In FIGS. 1*a* and 1*b,* the parts for the mechanical drive are removed. This independent motor/reductor 1 can thus be assembled without modifying the embodiment of an existing machine. For one skilled in the art it will be obvious that the motor can also be secured in a mirror-image position, i.e. on the opposite end of the transverse driving shaft of the gripper bar chains. Thus, the motor/reductor 1 can be located in an "operator's side" (OS) position, rather than in an "opposite operator's side" (OOS) position. The independent motor/reductor 1 can also be mounted in a position between frames 7, 8 and actuate the transverse shaft 2 by known means such as pinions, belts, chains, and so forth, which permits removal of the driving side unit 4, which can reduce the width dimension of the device.

The independent motor/reductor 1 actuating the endless gripper bar chains 5, 6 is preferably an electric motor of high dynamic regulation. This independent motor/reductor 1 can be selected from among synchronous motors, asynchronous motors, and d.c. motors, with or without a motor brake, as are commercially available. For example, the inventors conducted tests using a brushless synchronous driving device comprising a motor type HXA60VH distributed by ABB Normelec S.A. (Switzerland) to drive the endless gripper bar chains 5, 6 of a converting press. The conveyor and converting press were driven at significant rates, while the original mechanical driving means was removed. Several manufacturers offer electric motors with standard coupling embodiments able to withstand up to 200–500 Nm, permitting the gripper bar chains to reach accelerations up to 25 to 70 $m/s^2$. The cost of such standard motors is lower than the cost of the equivalent mechanical elements of known devices.

Figure 2:
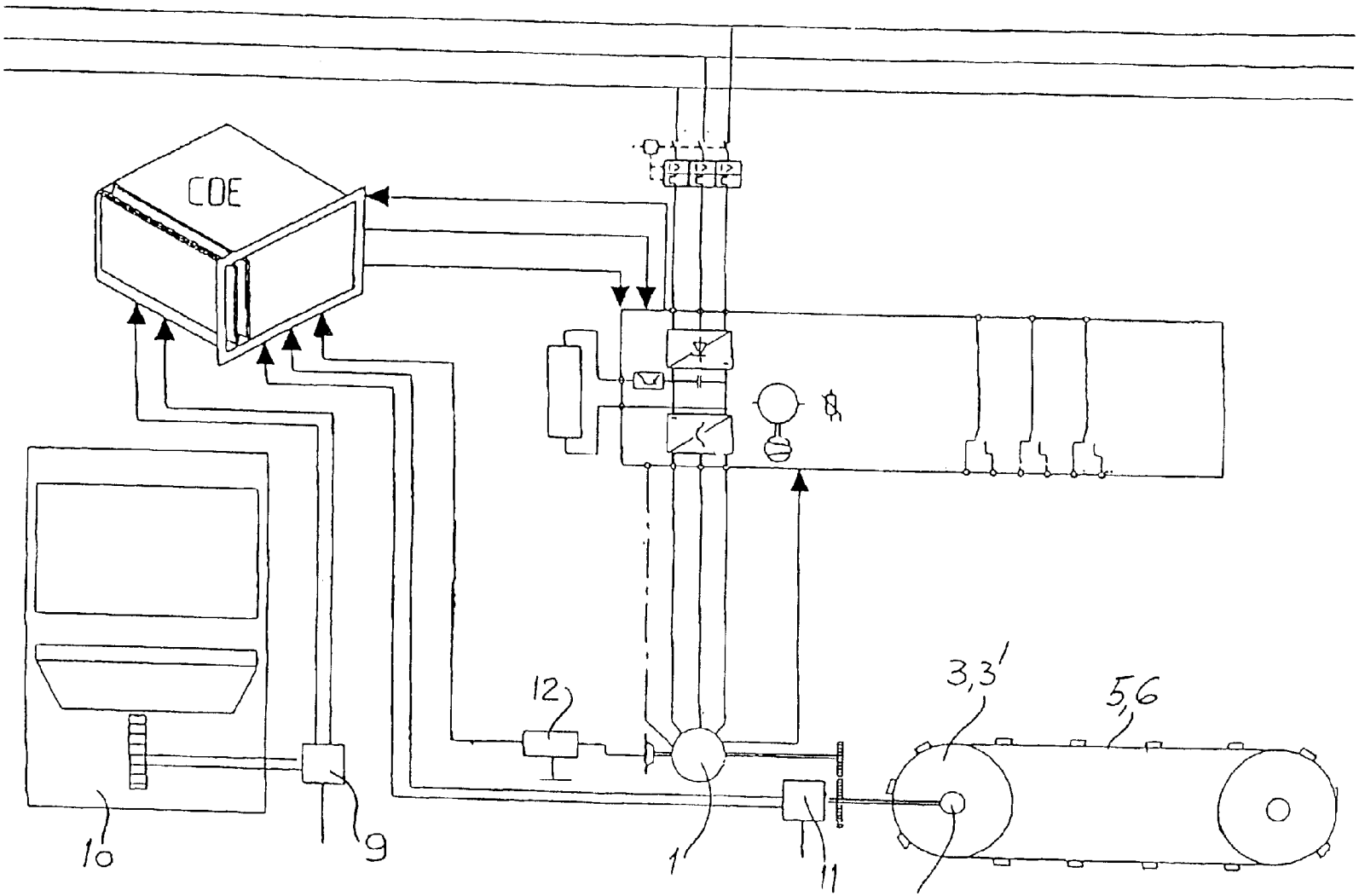
FIG. 2 is a diagrammatic view of a control device for the driving motor and of FIGS. 1*a* and 1*b.

FIG. 2 shows the schematic diagram of the electronic control device of the independent motor/reductor 1. The CDE control device receives from an absolute and incremental coder 9 a signal representing the exact location of a blanking platen 10, this signal being used as a master reference within the whole system. The CDE control device also receives from an absolute and incremental coder 11 the absolute location of the gripper bar chains 5, 6. The CDE control device also receives the angular position of the independent motor/reductor 1 scanned by an absolute and incremental coder 12. The comparison between these signals allows the electronic CDE control device to exactly define the engaging and releasing times of the independent motor/reductor 1, i.e. to define the beginning and the end of the braking phase, and to issue the current/tension feeding instructions defining, at any time accelerations and speed rates for the independent motor/reductor 1.

Figure 3:
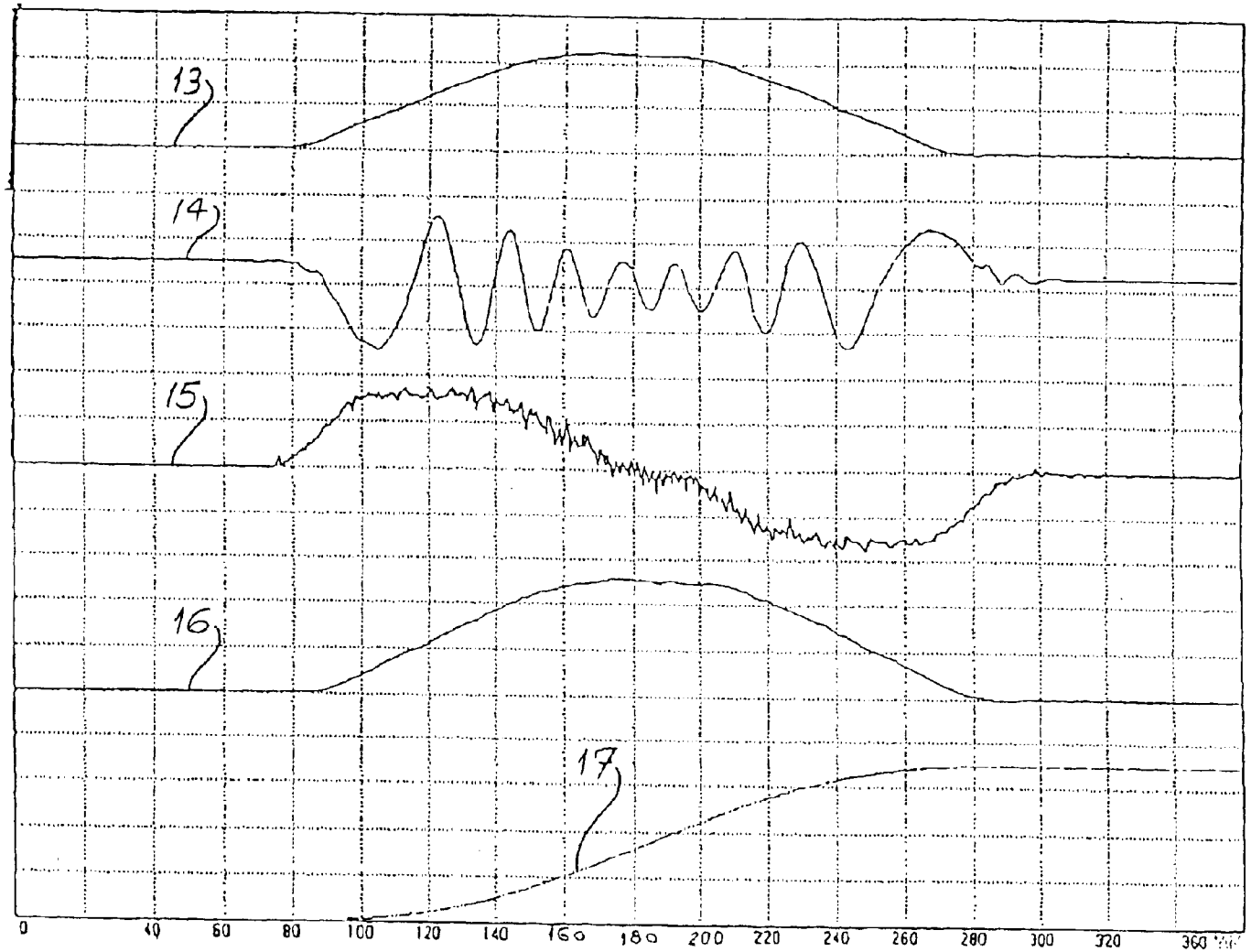
* and FIG. 3 shows a signal chart for cycle characteristics.

FIG. 3 shows five curves 13 to 17 on a same diagram, showing in arbitrary units various operating characteristics of the motor with the conveyor. Curve 13 illustrates conveyor tension, while the curve 14 shows the intensity of the current feeding the independent motor/reductor 1. Curve 15 provides an indication of the acceleration, while curve 16 shows the speed reached. Curve 17 shows the angular motion of the independent motor/reductor 1. In FIG. 3, the X-coordinate axis represents the angular rotation of the independent motor/reductor 1 during one rotation, that is to say 360°, which corresponds to a sheet traveling from one station to the next.

Of note on these curves is the relationship between control tension and speed as well as the lack of excessive accelerations. By modifying the preset tension curve, one can easily remove the constant speed motion phase, or lengthen or shorten the motion phase duration in a given cycle.

What is claimed is:

1. A method for operating a conveyor drive for a conveyor independently of a drive for a press station serviced by the conveyor, the method comprising:

generating a press station position signal related to an operating position of said press station;

providing said position signal to a motor controller for operating said conveyor drive;

computing a set of parameters defining a drive profile for operating said conveyor drive based on said position signal; and applying said drive profile to said conveyor drive to operate said conveyor drive, wherein said conveyor drive is operated in synchronization with said press station.

2. A method according to claim 1, further comprising calculating at least one of a duration and amplitude of one or more of said drive profile parameters in relation to said position signal.

3. A method according to claim 2, wherein said parameters defining said drive profile include acceleration, deceleration and braking.

4. A method according to claim 1, further comprising:

generating a conveyor position signal related to an operating position of said conveyor;

providing said conveyor position signal to said motor controller for operating said conveyor drive; and computing said drive profile for operating said conveyor drive based on said conveyor position signal and said press station position signal.

5. A method according to claim 1, further comprising:

generating an angular position signal related to an operating position of said conveyor drive;

providing said angular position signal to said motor controller for operating said conveyor drive; and computing said drive profile for operating said conveyor drive based on said angular position signal and said press station position signal.

6. A method for operating a conveyor drive for a conveyor independently of a drive for a press station serviced by the conveyor, the method comprising:

generating a press station position signal related to an operating position of said press station;

providing said position signal to a motor controller for operating said conveyor drive;

computing a set of parameters defining a drive profile for a complete operating cycle of said conveyor based on said position signal, wherein said operating cycle comprises a moving phase in which a conveyed article is delivered to the press station by said conveyor, and a non-moving phase during which the conveyor pauses to permit an operation to be performed on the conveyed article by the press station; and applying said drive profile to said conveyor drive to operate said conveyor drive, wherein said conveyor drive is operated in synchronization with said press station.

* * * * *